US007211011B1

(12) United States Patent
Sutherland

(10) Patent No.: US 7,211,011 B1
(45) Date of Patent: May 1, 2007

(54) ARROW WITH CHEMICAL LIGHT SOURCE

(76) Inventor: Warren Sutherland, 469 Silver Fox Dr., Louisa, KY (US) 41230

( * ) Notice: Subject to any disclaimer, the term of this patent is extended or adjusted under 35 U.S.C. 154(b) by 0 days.

(21) Appl. No.: 11/349,867

(22) Filed: Feb. 8, 2006

(51) Int. Cl.
*F42B 6/04* (2006.01)
*F42B 6/06* (2006.01)

(52) U.S. Cl. ..... 473/578; 473/570

(58) Field of Classification Search ..... 473/570, 473/578

See application file for complete search history.

(56) References Cited

U.S. PATENT DOCUMENTS 4,340,930 A 7/1982 Carissimi
4,856,792 A 8/1989 Hardison
4,989,881 A * 2/1991 Gamble ..... 473/570
5,058,900 A 10/1991 Denen
5,134,552 A 7/1992 Call et al.
5,562,290 A * 10/1996 Wei ..... 473/570
6,123,631 A * 9/2000 Ginder ..... 473/570
6,364,499 B1 4/2002 Jones
6,390,642 B1 5/2002 Simonton
6,533,688 B1 * 3/2003 Huang ..... 473/578
6,736,742 B2 * 5/2004 Price et al. ..... 473/570
2004/0184274 A1 * 9/2004 DiCarlo ..... 362/458

* cited by examiner

*Primary Examiner*—John A. Ricci
(74) *Attorney, Agent, or Firm*—Waters Law Office; Robert R. Waters; Olen L. York, III

(57) ABSTRACT

A nock or an arrow having a nock with a chemical light source allows an archer or hunter to more easily locate and retrieve an arrow that has been shot from a bow. The nock is inserted into an arrow, wherein the nock comprises a body having an end for receiving a bowstring and an insert projecting from an opposing end. The body is formed of a translucent material for transmitting the light so that the light is visible to a user or others. The nock has a recess formed in the insert and the body. A chemiluminescent lightstick is utilized as the light source, and the insert is inserted into an end of the arrow.

7 Claims, 3 Drawing Sheets

ARROW WITH CHEMICAL LIGHT SOURCE

RELATED U.S. APPLICATION DATA

Not applicable.

FIELD OF THE INVENTION

This invention relates generally to an archery or hunting arrow, and, more specifically, this invention relates to an archery or hunting arrow having a transparent or translucent nock with a light source therein for illuminating the path and/or location of a released/shot arrow.

BACKGROUND OF THE INVENTION

It is sometimes difficult to locate released/shot arrows, especially at low light and/or in dense forest or brush. Camouflage or neutral colored arrows shot by the hunter can become lodged in undergrowth making the arrow difficult to find. As a result, expensive arrows are lost and must be replaced, thus raising the expenses of a hunter. Accordingly, there is a need for a device that solves the aforementioned deficiencies and aids a hunter in retrieving a released/shot arrow.

Several alternatives have been offered to solve the aforementioned problems, including the disclosures of U.S. Pat. Nos. 4,340,930, 4,421,319 and 4,547,837, which collectively describe and disclose audible or visual signals incorporated into a hunting arrow for location and retrieval of the arrow. Of particular interest is U.S. Pat. No. 4,856,792, issued to Phillip Hardison, which discloses an archer's arrow having a chemical light source for aiding in locating the arrow after the arrow has been shot from a bow. In particular, what is described and claimed is an arrow having a nock within which the chemical light source is placed. The nock has an end (insert) that attaches to the shaft, a notch at an opposing end for receiving the bow string, and a cavity formed in the nock body for receiving and housing a chemiluminescent lightstick. The lightstick is held in place by a pair of backstop plates located off center at opposing ends of the cavity.

The present invention overcomes the deficiencies of the prior art and provides enhanced visibility of an arrow shot from a bow. The result is an advantage for the hunter to watch the flight and the direction of the arrow, which helps in the finding and the retrieval of expended arrows, thus saving the hunter the expense of replacing lost arrows. The present invention addresses the recent changes that have been made in nocks, so that the nock is more internally located within arrow and arrow shaft, and thus less susceptible to damage or accidental removal from the arrow shaft. The present invention is lighter than existing products, thus providing an added advantage of reducing the affects of added weight on the speed and arrow performance of a shot arrow. This is also a less expensive alternative to current marketed products, since added weight increases the expense and cost of existing lighted nock inventions.

The present invention provides an unanticipated and nonobvious improvement over the Hardison patent. In one embodiment of the present invention, one unanticipated and nonobvious improvement is the element and feature of a recess formed in the insert and the body of the nock into which an activated chemiluminescent lightstick is inserted and frictionally impinged therein. The lightstick is partially enveloped by the insert and the body of the nock when the lightstick is initially inserted into the insert and body. After the nock is then inserted into the end of the arrow shaft, the lightstick is completely enveloped by the combination of the arrow shaft, the insert and the body of the nock, thus protecting the lightstick from easily falling out of the nock. The present invention also does not require the use or need for backstop plates to retain the lightstick, which reduces the cost of manufacturing and the ease of assembly and disassembly when compared to the elements required in the Hardison patent.

In another embodiment of the present invention, another unanticipated and nonobvious improvement is the elements and features of a nock having a chamber in which a first compartment and a second compartment are positioned, the compartments housing chemicals, that when mixed, will generate a chemiluminescent light. One compartment is formed of a material that may be pierced, punctured, ruptured, fractured or otherwise broken so that the chemicals from the respective compartments are mixed to generate the light.

As such, the aforementioned description illustrates the differences, distinctions and advantages provided by the present invention in light of the prior art. Thus, the present invention is an improvement over the prior art, fulfilling a need and overcoming the deficiencies described and inherent in the prior art.

SUMMARY OF THE INVENTION

In one embodiment of the present invention, a nock is disclosed as being inserted into an arrow, in which the nock comprises a body having an end for receiving a bowstring and an insert projecting from an opposing end. The body is formed of a translucent material for transmitting the light so that the light is visible to a user or others. The nock has a recess formed in the insert and the body. A chemiluminescent lightstick is utilized as the light source, wherein the lightstick is activated and inserted into the recess before the nock is inserted into the arrow body. The insert is inserted into an end of the arrow.

In another embodiment of the present invention, an arrow for archery or hunting is disclosed, in which the arrow has a light source comprising an arrow body having a sharp point and fletching at opposing ends of the arrow body. A nock that is inserted into the end of the arrow body, adjacent the fletching, is included. The nock has a notch at an end for receiving a bowstring and an insert at an opposing end. The insert of the nock is inserted into an end of the arrow body. The nock has a recess formed in the insert and the body. The nock is formed of a translucent material. A chemiluminescent lightstick is utilized as the light source, wherein the lightstick is activated and inserted into the recess before the nock is inserted into the arrow body.

In another embodiment of the present invention, a nock is disclosed in which the nock is inserted into an arrow, wherein the nock comprises a body having an end for receiving a bowstring and an insert projecting from an opposing end. The body is formed of a translucent material for transmitting the light through the nock so that the light is visible to the user and others. A chamber is formed in the insert and in the body, the chamber having a first compartment and an adjacent second compartment. The compartments house different chemicals, and with the chamber having means for rupturing the second compartment and mixing the chemicals of the first compartment with the chemicals of the second compartment for generating chemiluminescent light. The rupturing means has a head and a point at an end opposite the head, wherein the head is exposed within the notch. The rupturing means is urged toward and ruptures the second compartment in response to force applied to the head by placement of the bowstring within the notch. The insert is inserted into an end of the arrow.

In another embodiment of the present invention, an arrow having a light source is disclosed, the arrow having a light source comprising an arrow body having a sharp point and fletching. A nock is included, the nock having a notch at an end for receiving a bowstring and an insert at an opposing end, and wherein the insert inserted into an end of the arrow body. The nock is formed of a translucent material. The nock has a chamber, the chamber having a first compartment and an adjacent second compartment. The compartments house different chemicals. The chamber has means for rupturing the second compartment and mixing the chemicals of the first compartment with the chemicals of the second compartment for generating chemiluminescent light. The rupturing means has a head and a point at an end opposite the head, wherein the head is exposed within the notch. The rupturing means is urged toward and ruptures the second compartment in response to force applied to the head by placement of the bowstring within the notch.

In the aforementioned embodiments, the body of the nock has an end for receiving the bowstring and comprises a notch formed by a pair of legs separated by a distance sufficient to receive the diameter of the bowstring. The insert of the nock has a diameter smaller than the body, wherein the diameter of the insert is offset so as to align the exterior of the body substantially coplanar (and coextensive) to the exterior of the arrow. The recess has a diameter slightly smaller than the diameter of the lightstick so as to frictionally impinge the lightstick therein. The nock is removable from the arrow and replaceable by another nock if desired. The lightstick is removable from the nock and replaceable by another lightstick when the light is exhausted or requires replacement for continued use and operation of the nock. The nock may comprise a transparent or translucent material of a color desired by the user, and preferably coordinated with the appearance or aesthetics of the arrow body. Likewise, the lightstick(s) may comprise a variety of colors that may be coordinated with the color of the nock and/or the color of the arrow body.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way. It is intended that the application is defined by the claims.

BRIEF DESCRIPTION OF THE DRAWINGS

Additional utility and features of the invention will become more fully apparent to those skilled in the art by reference to the following drawings, which illustrate the primary features of the preferred embodiment and numerous alternative embodiments.

DETAILED DESCRIPTION OF THE PREFERRED EMBODIMENT

The detailed description below is for preferred embodiments and is intended to explain the current invention. It is to be understood that a variety of other arrangements are also possible without departing from the spirit and scope of the invention.

The present invention is generally directed to a hunting arrow. More specifically, the nock end of the arrow is configured to house a light source so as to allow the hunter to visually follow the flight and also aid in the finding and retrieval of a hunter's arrow. The features of the nock and/or the arrow of the present invention will be more fully understood by referring to the attached drawings in connection with the following description.

The present invention may be generally characterized and depicted in at least two different embodiments. One embodiment may be generally characterized as a nock having a light source, wherein the nock is inserted into an end of an arrow. Another embodiment may be generally characterized as an arrow having a light source, wherein the light source is housed in a nock that is inserted into an end of the arrow.

Figure 1:
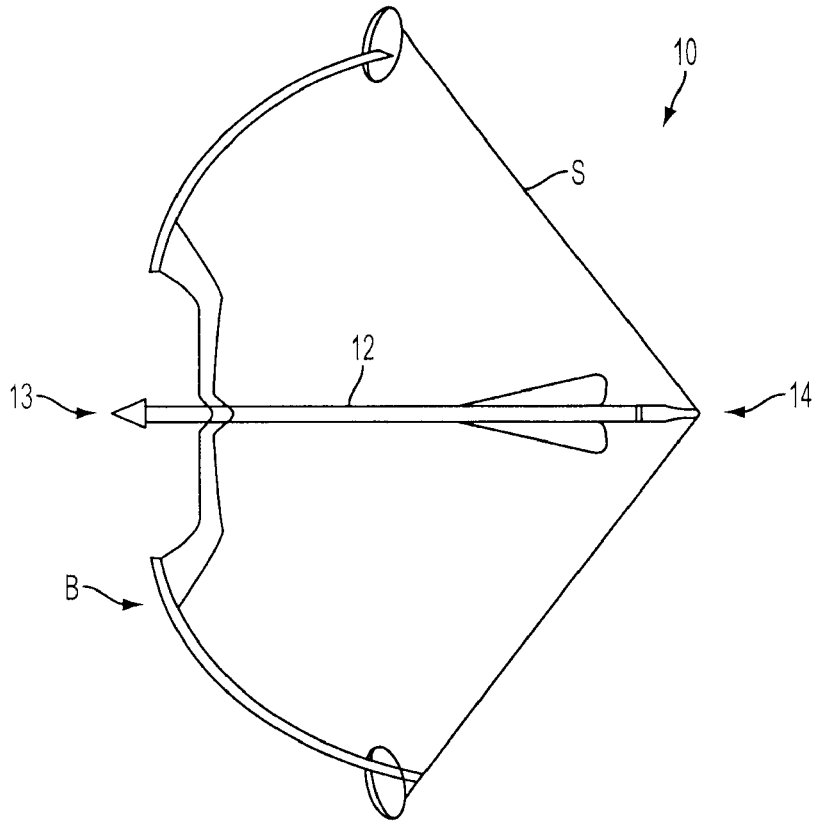
FIG. 1 is the side elevation view of a bow with a drawn arrow depicting the first end of an arrow and the second or nock end of an arrow.
Figure 2:
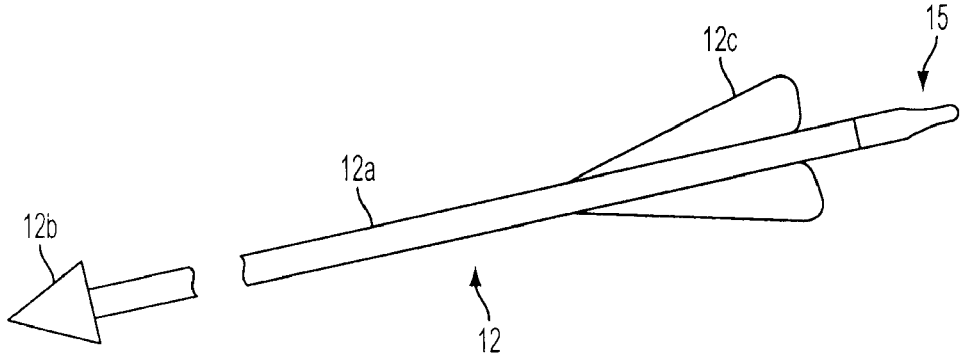
FIG. 2 is a partial side elevation view of an arrow shaft with nock inserted.
Figure 3:
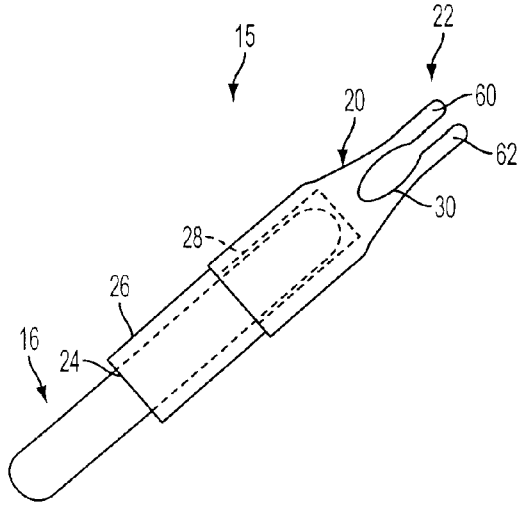
FIG. 3 is a side elevation view of a nock with a chemically activated tube inserted into the nock.
Figure 4:
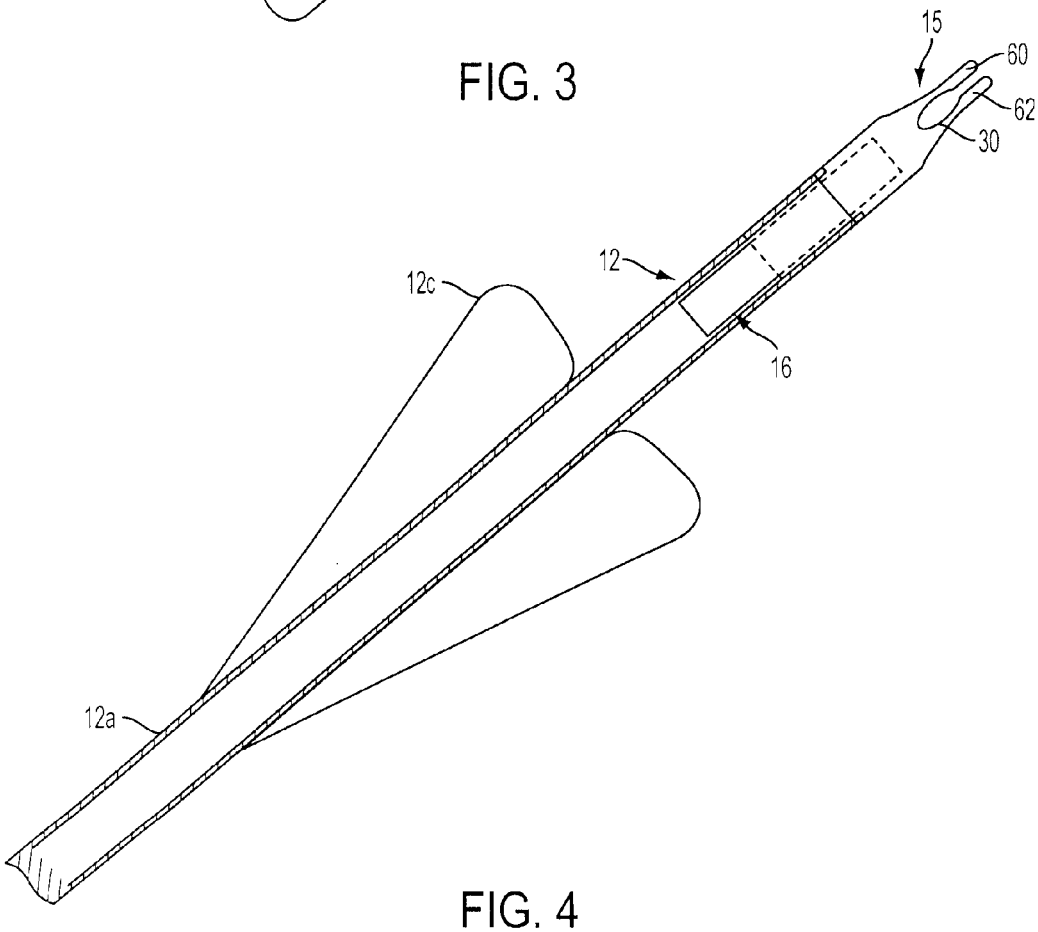
FIG. 4 is a partial side elevation view of the chemically activated tube inserted in the nock which is inserted into the arrow shaft.

In particular, the present invention is generally denoted by the reference numeral 10. In FIG. 1, an archery or hunting bow B has a drawn arrow 12 with a first end 13 and a second end 14. As depicted in FIG. 2, the nock 15 is inserted into the second end 14 of arrow 12. FIG. 3 depicts the chemically activated tube 16 inserted into the nock 15. FIG. 4 depicts the chemically activated tube 16 inserted into the nock 15 which are then inserted into the second end 14 of the arrow 12.

Figure 5:
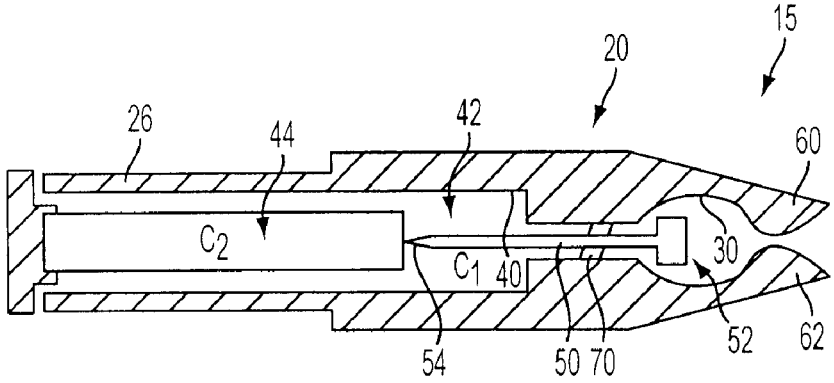
FIG. 5 is a side elevation view of a nock comprising of chemicals and a sharp object at the end of nock that accepts archer's bow string.

In FIG. 5, the nock 15 comprises chemicals that are separated. Upon insertion of bowstring S into the end of the nock 15, the bowstring S pushes or urges a sharp object 54 forward, rupturing a tube or compartment 44, the rupture allowing the chemicals to mix, which will then generate and emit a glow through translucent or clear nock 15.

Referring now specifically to FIG. 1 through FIG. 4, a nock 15 that is inserted into an arrow 12 comprises a body 20 having an end 22 for receiving a bowstring S and an insert 26 projecting from an opposing end 24. The body 20 is formed of a translucent material so that the chemiluminescent light generated within or inside the nock 15 is easily transmitted through the body 20 and is externally visible to the user. A recess 28 is formed in the insert 26 and the body 20, the recess 28 for receiving a chemiluminescent lightstick 16 that is activated and then inserted into the recess 28. The insert 26 is inserted into an end 14 of the arrow 12, either replacing the original nock or becoming the original nock in a newly manufactured arrow.

In another embodiment of the present invention, the invention may be characterized as an arrow having a light source, wherein the arrow 12 comprises an arrow body 12*a* having a sharp point 12*b* and fletching 12*c*. The arrow 12 includes a nock 15 having a notch 30 at an end for receiving a bowstring S and an insert 26 at an opposing end 24. The nock 15 is substantially identical to the nock 15 described above, and may include the additional elements and features disclosed below in relation to all embodiments described herein.

In an alternate embodiment relating to the nock 15, the nock 15 has a chamber 40, wherein the chamber 40 having a first compartment 42 and an adjacent second compartment 44. The chamber 40 is defined by the interior of the nock 15, and more specifically, the interior of the insert 26 and a portion of the main body 20. The portion of the chamber 40 that sets adjacent the notch 30 includes a divider 70, through which a rupturing means 50 (described in greater detail below) is allowed to penetrate for the purpose of rupturing the second compartment 44 (as further described below). The compartments 42 and 44 house different chemicals (referenced as chemicals $C_1$ and $C_2$, respectively), wherein the first compartment 42 may house chemical(s) $C_1$, and the second compartment 44 may house chemical(s) $C_2$. The chamber 40 has means 50 for rupturing the second compartment 44 so that the chemical(s) $C_1$ of the first compartment 42 are mixed with the chemical(s) $C_2$ of the second compartment 44 for generating chemiluminescent light.

In one embodiment, the rupturing means 50 has a head 52 and a point 54 at an end opposite the head, wherein the head 52 is exposed within the notch 30. The rupturing means 50 is urged toward and ruptures the second compartment 44 in response to force applied to the head 52 by placement of the bowstring S within the notch 30. The tension placed on the bowstring S by the bow places a force on the head 52 of the rupturing means 50 and urges the point 54 into the second compartment 44, thereby rupturing the second compartment 44 and allowing the chemical(s) $C_1$ of the first compartment 42 and the chemical(s) $C_2$ of the second compartment 44 to mix and generate the chemiluminescent light. The insert 26 is inserted into an end of the arrow 14, either replacing the original nock or becoming the original nock in a newly manufactured arrow. Other embodiments of rupturing means 50 are envisioned, including variations in the type of head 52 and/or point 54 that may be specifically utilized.

In one, some or all of the aforementioned embodiments of the nock 15, the end of the body 20 for receiving the bowstring S comprises a notch 30 formed by a pair of legs 60 and 62 separated by a distance sufficient to receive the diameter of the bowstring S. The legs 60 and 62 may be parallel or slightly angled so to prevent the bowstring S from inadvertently coming free from the notch 30 and the legs 60 and 62. The insert 26 has a diameter smaller than the body 12*a* of the arrow 12, the diameter of the insert 26 offset so as to align the exterior of the body 20 of the nock 15 substantially coplanar and coextensive to the exterior of the arrow 12 (and specifically, the shaft of the arrow). The recess 28 has a diameter slightly smaller than the diameter of the lightstick 16 so as to frictionally impinge the lightstick 16 therein.

It is envisioned that the chemiluminescent lightstick 16, or the chemicals $C_1$ and $C_2$ utilized and stored in compartments 42 and 44 in one alternate embodiment of the nock 15, are sufficiently similar to the lightsticks and/or chemicals used within lightsticks that are commercially available. As such, the nock 15 may include liquid, viscous liquid, or solid chemiluminescent reagents that are held in lightstick 16 or in the compartments 42 and 44. The chemiluminescent chemical employed is envisioned as being similar to the chemicals disclosed in U.S. Pat. Nos. 3,539,794, 3,576,987, 4,193,109, 4,682,544, 4,751,616, 4,814,949 and 5,121,302. Such lighting devices generally involve the use of two compartments, one compartment containing a first liquid chemical referred to as an oxalate solution, and the second compartment containing a second liquid chemical referred to as an activator solution. These two compartments must have a barrier to maintain separation of the oxalate and activator until use since the oxalate solution is sensitive to any contamination. Therefore, in practice, the oxalate solution is typically enclosed in a breakable glass ampule. Typically, the chemical light is produced by mixing an oxalate ester and hydrogen peroxide together in the presence of a catalyst and a fluorescer.

Chemiluminescent light production generally utilizes a two-component system to chemically generate light. Chemiluminescent light is produced by combining the two components, which are usually in the form of chemical solutions referred to as the "oxalate" component and the "activator" component. All suitable oxalate and activator compositions, inclusive of the various additional fluorescers, catalysts and the like, known to be useful in the prior art, are contemplated for use within the present invention.

When chemiluminescent materials are stored, the two components are kept physically separated prior to activation by a variety of means. Often, a sealed, frangible, glass vial containing one component is housed within an outer flexible container containing the other component. This outer container is sealed to contain both the second component and the filled, frangible vial. Forces created by intimate contact with the internal vial, e.g. by flexing, cause the vial to rupture, thereby releasing the first component, allowing the first and second components to mix and produce light. Since the objective of this type of device is to produce usable light output, the outer vessel is usually composed of a clear or translucent material, such as polyethylene or polypropylene, which permits the light produced by the chemiluminescent system to be transmitted through the vessel walls. These devices may be designed so as to transmit a variety of colors by either the addition of a dye or fluorescent compound to one or both of the chemiluminescent reactant compositions or to the vessel. Furthermore, the device may be modified so as to only transmit light from particularly chosen portions thereof. The specificity of the chemical interaction of the particular chemicals utilized is represented and explained in U.S. Pat. No. 6,832,392 (issued to Palmer et al.), the relevant portions of which are incorporated by reference as if fully rewritten herein.

In the present invention, including all the embodiments, and concerning the lightstick 16, it is envisioned that the apparatus 10 will utilize a breakable glass ampule housing the oxalate solution, and that the glass ampule can be easily broken to activate the chemical activity to generate the desired light. Concerning the use of a nock 15 having a chamber 40 with separate compartments 42 and 44, it is envisioned that the second compartment 44 may be formed of breakable glass, plastic, rubber or some other pierceable or breakable material, anticipated to have a thin membrane or thickness so that the force applied to rupturing means 50 is sufficient to cause the point 54 to pierce or rupture the membrane or shell of the second compartment 44.

In the present invention, including all the embodiments, it is envisioned that the nock 15 may be formed of a transparent or translucent material that may be clear or have a particular color. It is envisioned that a choice of colors may be provided so that the user can color coordinate the nock 15 to the arrow body or shaft, if desired. In addition, it is envisioned that the user may desire a particular color of the nock 15 out of personal preference or to accommodate the specific vision of the user (some users may not be able to detect specific colors, or may be able to detect only a limited number of colors). The nock 15 is considered to be disposable in the sense that the nock 15 may be removed from the arrow body and replaced by another nock 15 as needed or required. For instance, the nock 15 may sustain damage and may need to be removed and replaced by a new nock.

It is also envisioned that an individual lightstick may be provided in a number or variety of colors that may be color coordinated with the nock 15, the arrow body, or both, if desired, or to meet the particular desires of the user. It is also envisioned that an individual lightstick is disposable in the sense that the lightstick may be removed from the nock 15 and replaced with a new lightstick when the original lightstick is exhausted or damaged.

The foregoing descriptions of specific embodiments of the present invention have been presented for purposes of illustration and description and are not intended to be exhaustive or to limit the invention to the precise forms disclosed. Obviously many modifications and variations are possible in light of the above teaching. The embodiments were chosen and described in order to best explain the principles of the invention and its practical application, and enable others skilled in the art to best utilize the invention and various embodiments. It is intended that the scope of the invention be defined by the Claims appended hereto and their equivalents. Therefore, the scope of the invention is to be limited only by the following claims.

What is claimed is:

1. A nock inserted into an arrow comprising:

a body having an end for receiving a bowstring and an insert projecting from an opposing end, the body formed of a translucent material;

a chamber formed in the insert and the body, the chamber having a first compartment and an adjacent second compartment, the compartments housing different chemicals, the chamber having means for rupturing the second compartment and mixing the chemicals of the first compartment with the chemicals of the second compartment for generating chemiluminescent light;

rupturing means having a head and a point at an end opposite the head, the head exposed within the notch, rupturing means urged toward and rupturing the second compartment in response to force applied to the head by placement of the bowstring within the notch; and the insert inserted into an end of the arrow.

2. The nook of claim 1, wherein the body having an end for receiving the bowstring comprises a notch formed by a pair of legs separated by a distance sufficient to receive the diameter of the bowstring.

3. The nock of claim 1, wherein the insert has a diameter smaller than the body, the diameter of the insert offset so as to align the exterior of the body substantially coplanar to the exterior of the arrow.

4. The nock of claim 1, wherein the nock is removable from the arrow and replaceable by another nock.

5. The arrow of claim 4, wherein the notch is formed by a pair of legs separated by a distance sufficient to receive the diameter of the bowstring.

6. The arrow of claim 4, wherein the nock is disposable.

7. An arrow having a light source comprising:

an arrow body having a sharp point and fletching;

a nock having a notch at an end for receiving a bowstring and an insert at an opposing end, the insert inserted into an end of the arrow body, the nock formed of a translucent material;

the nock having a chamber, the chamber having a first compartment and an adjacent second compartment, the compartments housing different chemicals, the chamber having means for rupturing the second compartment and mixing the chemicals of the first compartment with the chemicals of the second compartment for generating chemiluminescent light; and rupturing means having a head and a point at an end opposite the head, the head exposed within the notch, rupturing means urged toward and rupturing the second compartment in response to force applied to the head by placement of the bowstring within the notch.

* * * * *